US006817803B1

(12) United States Patent
Ong et al.

(10) Patent No.: US 6,817,803 B1
(45) Date of Patent: Nov. 16, 2004

(54) TOOTHBRUSH STRUCTURE

(75) Inventors: Patrick L. Ong, Pioneer, CA (US); Rebecca C. Ong, Pioneer, CA (US)

(73) Assignee: Patrick Ong, Pioneer, CA (US)

( * ) Notice: Subject to any disclaimer, the term of this patent is extended or adjusted under 35 U.S.C. 154(b) by 0 days.

(21) Appl. No.: 10/314,315

(22) Filed: Mar. 31, 2003

(51) Int. Cl.[7] ..... A46B 11/04; B43M 11/06

(52) U.S. Cl. ..... 401/280; 401/270; 401/281; 401/184; 401/186

(58) Field of Search ..... 401/271–278, 401/281, 183, 184, 185, 186, 270, 279, 280

(56) References Cited

U.S. PATENT DOCUMENTS

| | | | | | |
|---|---|---|---|---|---|
| 3,738,762 | A | * | 6/1973 | Moore et al. | 401/186 |
| 3,936,200 | A | * | 2/1976 | O'Rourke | 401/184 |
| 4,221,492 | A | | 9/1980 | Boscardin et al. | |
| 4,522,524 | A | * | 6/1985 | Green | 401/183 |
| 5,746,532 | A | | 5/1998 | Megill et al. | |
| 5,827,001 | A | | 10/1998 | Taghavi-Khanghah | |
| 5,846,010 | A | * | 12/1998 | Barbalich | 401/186 |
| 5,913,632 | A | | 6/1999 | Persad | |
| 6,027,273 | A | | 2/2000 | Li | |
| 6,056,466 | A | | 5/2000 | Johnson et al. | |
| 6,129,474 | A | | 10/2000 | Mitchell et al. | |
| 6,206,600 | B1 | | 3/2001 | Rosenberg et al. | |
| 2002/0025212 | A1 | | 2/2002 | Davis | |

* cited by examiner

*Primary Examiner*—David J. Walczak

(57) ABSTRACT

A toothbrush structure utilizing a handle having an open chamber and an aperture leading therefrom. The open chamber is sized to accommodate toothpaste and includes a flexible cover. A head portion is removably connected to the handle and possesses a brush structure and a passage for conducting toothpaste from the open chamber. Valve means controls the flow of toothpaste from the open chamber of the handle and the passage through the head portion.

16 Claims, 5 Drawing Sheets

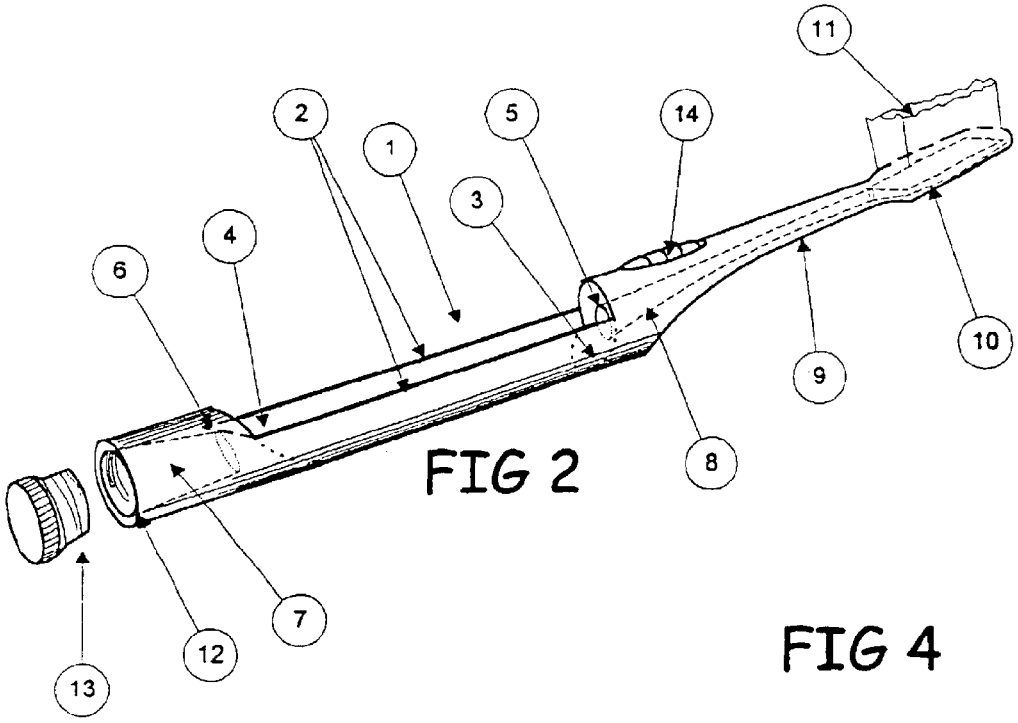
FIG 2
FIG 4
FIG 3
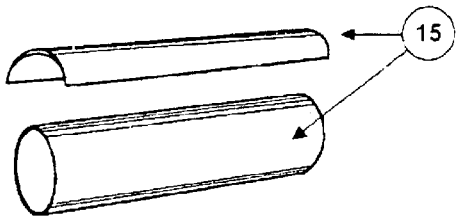
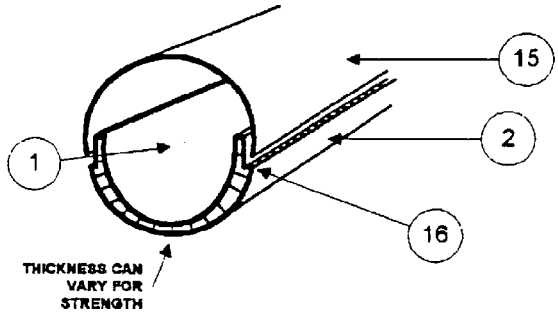

TOOTHBRUSH STRUCTURE

BACKGROUND OF THE INVENTION

The present invention relates to a novel and useful toothbrush structure holding and dispensing toothpaste.

In the past, dental hygiene has dictated the brushing of teeth at least on a daily basis. Such procedure normally entails the combining of a toothbrush and toothpaste dispensed from a separate toothpaste tube.

In the past, various structures have been proposed combining the handle for a toothbrush containing toothpaste and a head portion for dispensing such toothpaste to a brush structure extending from the head portion. Although such prior structures have been workable, they have not been successful due to bulkiness, entailing of expensive mechanisms for motivating the toothpaste to the brush structure, clogging of the toothpaste delivery system, and the like.

For example, U.S. Pat. Nos. 5,746,532, 5,827,001, 6,056,466, 6,129,474, and Published U.S. patent application No. 2002/0025212 describe toothbrush and toothpaste holder devices in which a piston is moved along the toothpaste containing chamber to force the toothpaste into the brush portion of the toothbrush head.

U.S. Pat. No. 5,913,632 describes a dentifrice dispensing toothbrush which employs an auger to advance the toothpaste to the bristle portion of the toothbrush.

U.S. Pat. No. 6,027,273 shows a toothbrush and toothpaste dispenser in which compressed gas is employed to move the toothpaste to the brush end.

U.S. Pat. Nos. 4,221,492 and 6,206,600 show toothbrush and toothpaste dispensers in which the handle portion is squeezable.

U.S. Pat. No. 5,846,010 describes a toothpaste dispensing toothbrush in which an elastomeric housing contains a tube of toothpaste and employs a valve to control the flow of toothpaste to the toothbrush portion.

A toothbrush structure which holds and dispenses toothpaste in a simple and efficient manner would be a notable advance in the dental arts.

BRIEF SUMMARY OF THE INVENTION

In accordance with the present invention a novel and useful toothbrush structure is hereinafter described.

The toothbrush structure of the present invention utilizes a handle which possesses an open chamber with a flexible portion. The chamber contains toothpaste and is easily refillable. The flexible portion may be a transparent cover which allows the user to apply pressure to the toothpaste to advance the same through an aperture from the chamber and along the handle. In many cases, the flexible portion may take the form of a polymeric material such as vinyl and the like.

A head portion is removably connected to the handle the head portion includes a brush structure and a passage therethrough. The passage possesses a first opening communicating with the aperture or bore of the handle. A head portion of the toothbrush structure is, thus, replaceable when wear or damage occurs on the brush structure.

Valve means is also found in the present invention for controlling the flow of toothpaste from the second opening of the passage through the head portion. Such valve means may take the form of a slidable member which moves along a partially inclined ramp formed in the handle portion of the structure at the interface of the head portion and the handle portion. Such valve means may include an operator which is easily accessible to the user of the brush without interfering with the operation of the toothbrush structure. The valve means may also be formed into a rotatable cylinder with diversionary openings or drains.

Interconnection between the head portion and the handle portion may also include a slidable guide which may further take the form of a pair of inclined channels on the handle portion. The channels would include an indent which mates with at least one tongue or protuberance extending from the head portion.

It has been found that the toothbrush structure of the present invention may be constructed in a very compact and slim format and is susceptible to exterior contouring for esthetic purposes.

It may be apparent that a novel and useful toothbrush structure has been hereinabove described.

It is therefore and object of the present invention to provide a toothbrush structure which is capable of dispensing toothpaste and may be easily used to brush a user's teeth in a convenient and efficient manner.

A further object of the present invention is to provide a toothbrush structure which possesses a feel to the user, of the same, which resembles a conventional toothbrush but is capable of also dispensing toothpaste as a unit.

A further object of the present invention is to provide a toothbrush structure which is capable of dispensing toothpaste which is reusable and may be free standing.

Yet another object of the present invention is to provide a toothbrush structure for holding and dispensing toothpaste which includes a replaceable head portion having a brush part, and is capable of utilizing brush parts of varying hardnesses.

A further object of the present invention is to provide a toothbrush structure which utilizes a flexible handle portion and includes a cover which is capable of carrying indicia.

Another object of the present invention is to provide a toothbrush structure for holding and dispensing toothpaste which appears similar to a conventional toothbrush and is capable of design alterations.

A further object of the present invention is to provide a toothbrush structure for holding and dispensing toothpaste which includes a flexible portion that is sturdy.

A further object of the present invention is to provide a toothbrush structure that permits the use of multiple valve means to control the delivery of dentifrice to a bristle structure.

The invention possesses other objects and advantages especially as concerns particular characteristics and features thereof which will become apparent as the specification continues.

BRIEF DESCRIPTION OF THE SEVERAL VIEWS OF THE DRAWING

FIG. 2 is a sectional view taken along line 2—2 of FIG. 1.

FIG. 3 is a sectional view taken along line 3—3 of FIG. 1.

FIG. 4 is a partial broken side elevational view emphasizing the head portion of the toothbrush structure of the present invention.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which should be taken along with the previously delineated drawings.

Figure 1:
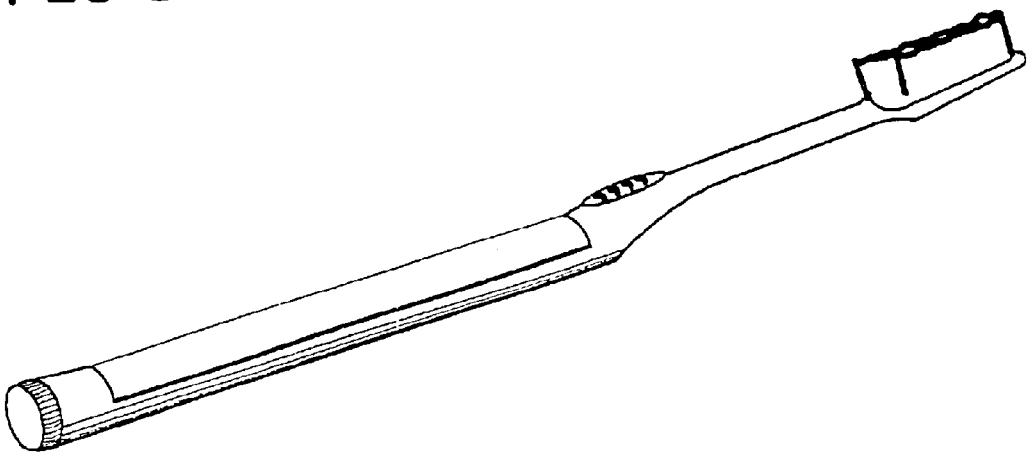
FIG. 1 is a side elevational view of the toothbrush structure of the present invention.
Figure 5:
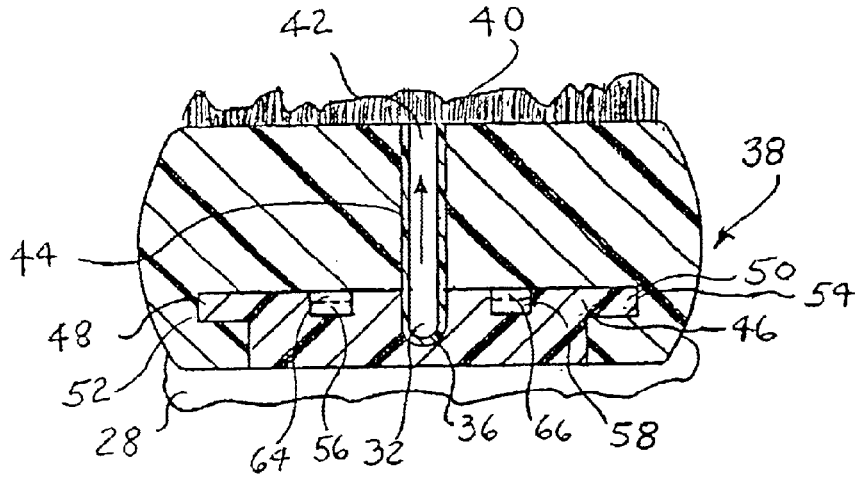
FIG. 5 is a sectional view taken along line 5—5 of FIG. 4.

The preferred embodiment of the invention as a whole is shown in the drawings by reference character 10. Toothbrush structure 10 is depicted in its entirety in FIG. 1 and includes a handle 12. Handle 12 possesses an open chamber 14 which is intended to hold toothpaste mass 16 therewithin. Body portion 18 is configured to be grasped by the user while a flexible cover 20 presses upon toothpaste mass 16 within chamber 14. Flexible cover 20 may be formed of any suitable material such as vinyl, polymeric plastics, and the like. Flexible portion 20 may be configured as roughly cylindrical or semi-cylindrical member, as depicted. Wall portions 22 and 23 of body portion 18 are mitered to reduce the wear upon flexible cover 20 when cover 20 is pressed. Markings or indicia 24 may be placed upon flexible cover 20 to provide an advertising message or similar legends. Flexible cover 20 also may be translucent or transparent to allow the user to observe the quantity of toothpaste mass 16 within chamber 14. Removable cap 26 is capable of threading or otherwise fitting within body 18 which is hollow to the extent of chamber 14. Handle 12 may be weighted to stand in an upright positioned when stored.

Handle portion 12 also includes a terminus 28 having a thumb grip 30. An aperture or bore 32 serves as a tunnel or conduit for toothpaste mass from chamber 14 to the end 34 of terminus 28. With reference to FIGS. 2 and 3, it may be observed that a tube 36 may lie within aperture 32 to aid in the guiding of toothpaste mass 16 therethrough.

Toothbrush structure 10 also includes a head portion 38 which possesses a bristle or brush part 40, intended to be employed in the brushing of teeth. Of course, brush part 40 may be of varying stiffness, dependent on the predilection of the user of toothbrush structure 10. Head portion 38 is built with a passage 42 which extends to brush part 40 and communicates with aperture or bore 32. Again, a tube 44 may lie within passage 42 or may be formed unitarily with tube 36 within aperture 32. In any case, toothpaste mass 16 in chamber 14 is free to pass to brush part 40 of head portion 38. End structure 46 of handle terminus 28 is formed with flanges 48 and 50. Head portion 38 likewise includes recesses 52 and 54 which slidingly engage flanges 48 and 50. Thus, head portion 38 is removable and replaceable relative to handle 12, shown in phantom on FIG. 1. End structure 46 also possesses channels 56 and 58 which extend along end structure 46 and terminate in indents or cavities 60 and 62, respectively. Tongues 64 and 66 of head portion 38 engage cavities 60 and 62 when head portion 38 is in the position shown in FIGS. 1 and 4.

Figure 6:
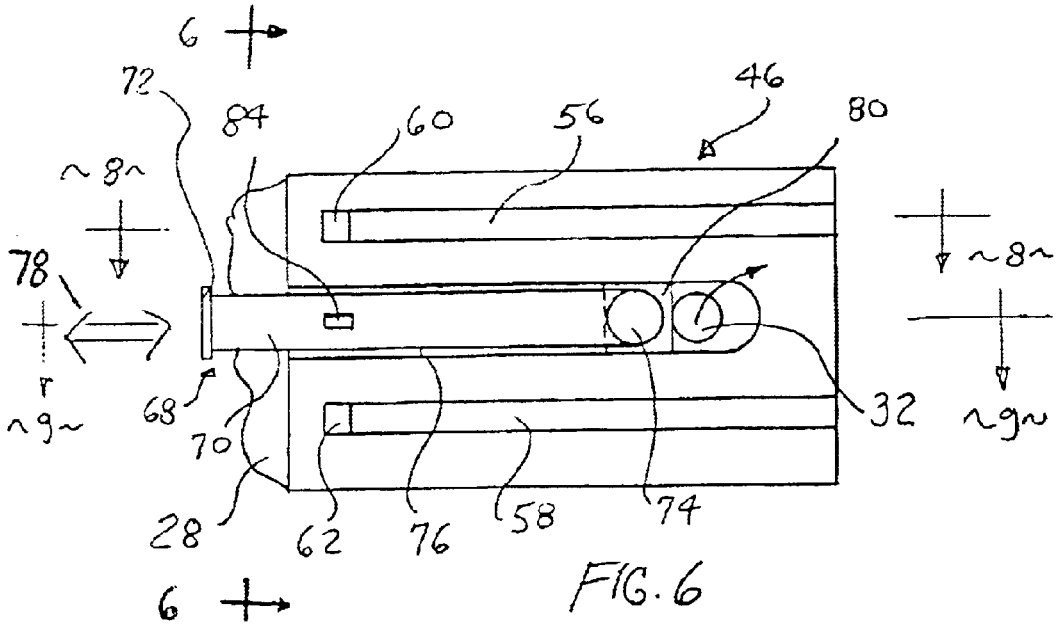
FIG. 6 is an enlarged top plan elevational view of the handle portion end structure which meets with the head portion removably fixed thereto.
Figures 7, 8:
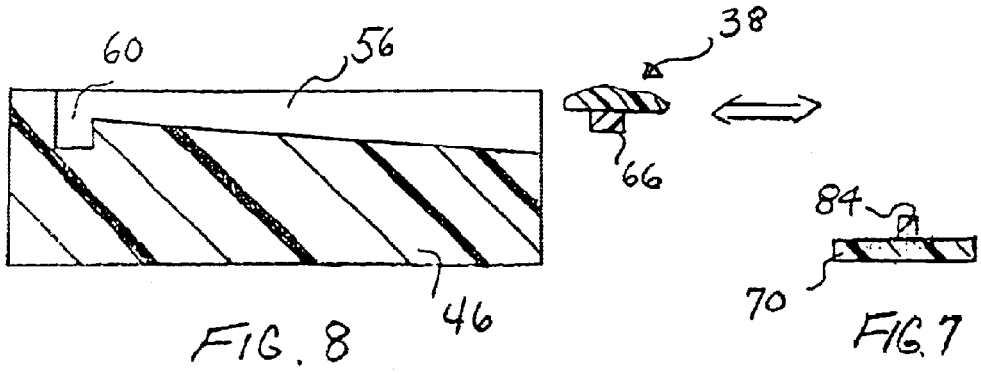
FIG. 7 is a sectional view of the slide member associated with the valve means taken along line 7—7 of FIG. 6.
FIG. 8 is a sectional view taken along line 8—8 of FIG. 6.
Figure 9:
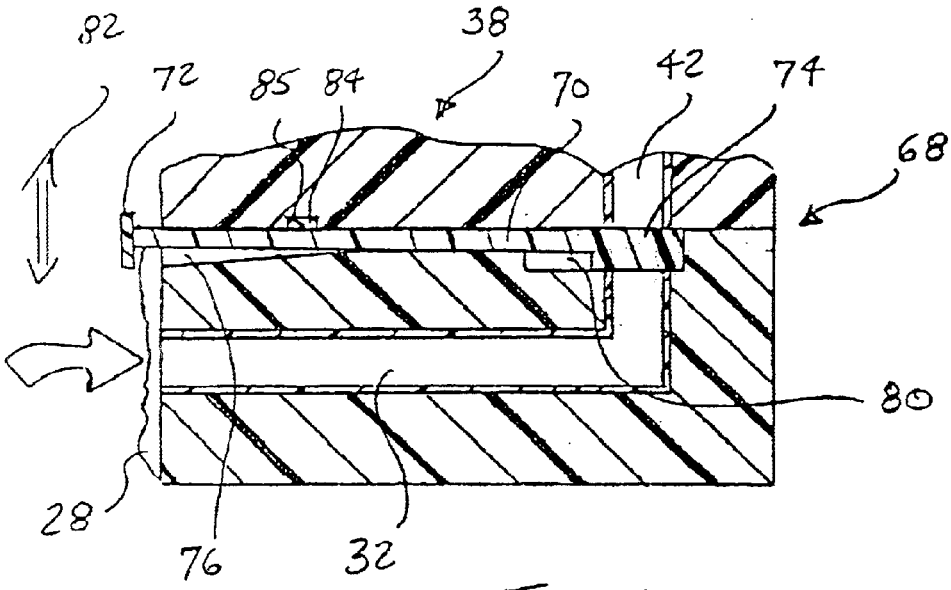
FIG. 9 is a sectional view taken along line 9—9 of FIG. 6.

With further reference to FIGS. 6, 7, and 9, toothbrush structure 10 includes as one of its elements valve means 68. Valve means 68 may take the form of a sliding member 70 having a grip or operator 72 at one end thereof. Operator 72 is accessible on the exterior of structure 10. Sliding member 70 also includes a plug 74 of flexible material that is capable of occluding aperture 32, as well as passage 42. Sliding member 70 is able to move back and forth along ramp 76 according to directional arrow 78, FIG. 6. Recess 80 encompasses plug 74 when sliding member is retracted from aperture 32. In addition, fin 84 on sliding member 70 fits into a channel 85 along head portion 38, to hold plug 74 in place at aperture 32. Directional arrow 82 illustrates the flexibility of sliding member 70.

Figure 10:
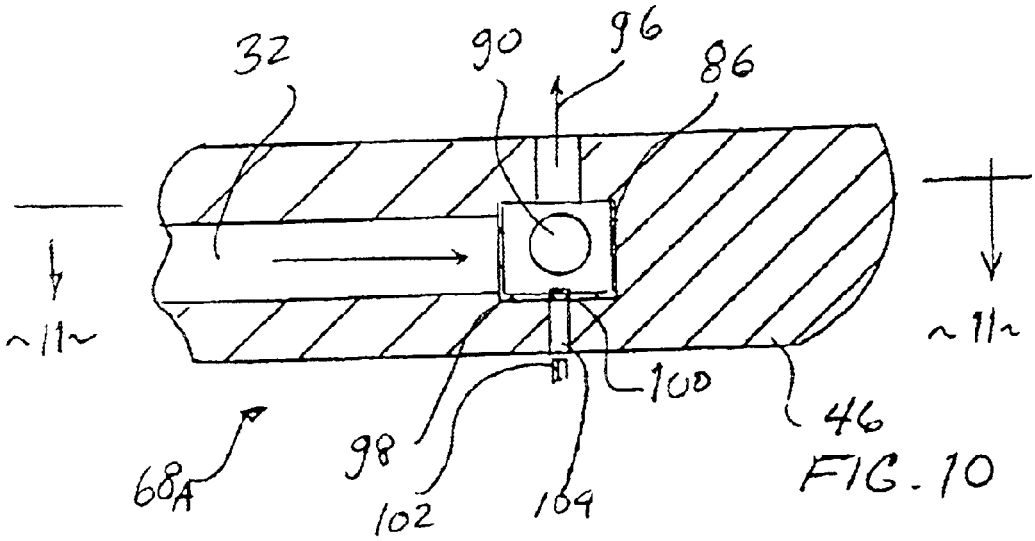
FIG. 10 is a sectional view of an alternate embodiment of valve means utilized with the present invention.
Figure 11:
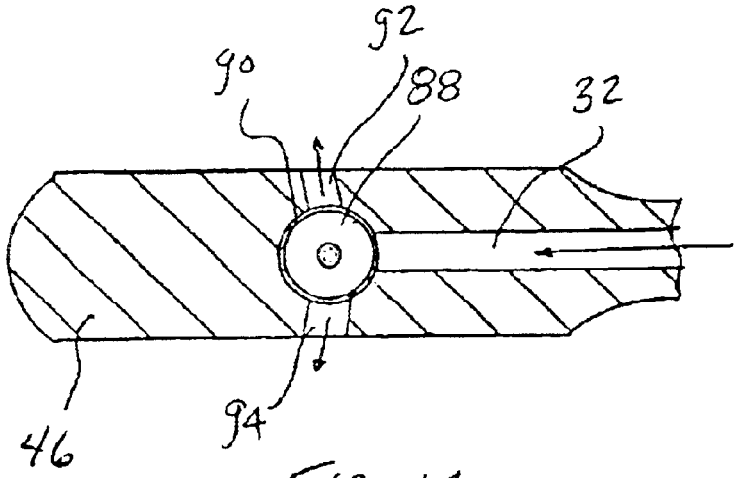
FIG. 11 is a sectional view taken along line 11—11 of FIG. 10.

Turning now to FIGS. 10 and 11, it may be observed that valve means 68A is shown schematically as another embodiment of valve means 68. Valve means 68A includes a rotatable cylindrical member 86 which includes an open mouth 88 and at least one opening 90 on its side portion. End portion 46 is also fitted with drainage holes 92 and 94. Thus, the rotation of cylindrical member 86 can either communicate with passage 32 for the acceptance of toothpaste mass to allow the same to pass to head portion 38 (not shown), directional arrow 96, or to open drainage holes 92 or 94. The base 98 of cylinder 86 may include a facetted opening 100 which accepts a wrench 102 in order to affect rotation of cylinder 86. Opening 104 through structure 36 is provided for access for wrench 102.

In operation, the user grasps toothbrush structure 12 at handle portion 12 using thumb grip 30. Toothpaste mass 16 has been placed in chamber 14 by the removal of cap 26 and the replacement of the same after filling during the manufacturing process or by the user. Pressing on flexible cover 20 urges toothpaste mass 16 through aperture 32 and passage 42 to brush part 40. Such passage takes place when valve means 68 is opened, specifically when sliding. member 70 has been pulled outwardly by gripping operator 72 and fin 84 has been lowered from channel 85. Plug 74 retreats from passageway 32 and squeezes into recess 80 of ramp 76 into a position indicated in FIG. 6. After use of brush part 40 of toothbrush structure 10 to clean teeth, the user pushes sliding member 70 back into place such that plug 74 of valve means 68 occludes passage 32. Again, operator 72 is employed for this purpose. Fin 84 will enter channel 85 at this position. In the alternative, cylinder 86 serving as valve means 68A is rotated within aperture 32 to either allow toothpaste to pass to head portion 38 passage 42 or to drain openings 92 or 94. Cylinder 86 is rotated by wrench 72 to achieve this end. Head portion 38 may be removed and replaced with a like portion possessing a brush part 40 having suitable characteristics. Such removal is initiated by the upper movement of sliding member 70 against head portion 38. Such movement lifts tongues 64 and 66 from recesses 60 and 62, respectively. Head portion 38 may then slide away from terminus 28 along channels 56 and 58 and separate from end structure 46. Replacement of head portion 32 or with a like item follows a reverse procedure.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A toothbrush structure for holding and dispensing toothpaste, comprising:

a. a handle, said handle extending along a longitudinal axis including a flexible portion having an open chamber and an aperture to said open chamber, said open chamber sized to accommodate the toothpaste, said aperture positioned to pass toothpaste from said open chamber upon the application of pressure on said flexible portion;

b. a replaceable head portion, longitudinally slidably received on said handle and including means for removably connecting said head portion to said handle, said head portion including a brush structure and a passage therethrough, said passage including a first opening and a second opening said first opening communicating with said aperture of said handle, said passage second opening positioned in the vicinity of said brush structure; and c. a separately formed valve member movable with respect to said handle and head portion when said handle and head portion are connected for controlling the flow of toothpaste from said aperture in said handle to said passage in said head portion, said valve member being movably retained on said handle and below said head portion and being accessible from an exterior of said handle and head portion to as to enable a user to open and close said valve member and wherein a user can access said valve member upon the removal of said head portion from said handle.

2. The structure of claim 1 wherein said flexible portion comprises a flexible cover superimposed on said open chamber of said handle.

3. The structure of claim 2 in which said flexible cover includes a surface for carrying indicia.

4. The structure of claim 3 in which said cover surface is translucent.

5. The structure of claim 2 in which said handle flexible cover is composed of a vinyl material.

6. The structure of claim 1 which additionally comprises a hollow tube positioned in the aperture of said handle.

7. The structure of claim 1 in which said handle having a ramp, and said valve member includes a sliding member movable along said ramp to occlude said aperture of said handle.

8. The structure of claim 7 in which said ramp is inclined.

9. The structure of claim 7 in which said sliding member further includes an operator accessible grip or operator at the exterior of said handle and head portion.

10. The structure of claim 1 in which said means for removably connecting said head portion to said handle comprises a channel formed in said handle, said channel including a cavity, and a tongue in said head said tongue mating with said ramp indent.

11. The structure of claim 10 in which said channel is inclined.

12. The structure of claim 10 wherein said flexible portion comprises a flexible cover superimposed on said open chamber of said handle.

13. The structure of claim 12 in which said flexible cover includes a surface for carrying indicia.

14. The structure of claim 13 in which said cover surface is translucent.

15. The structure of claim 12 in which said handle flexible cover is composed of a vinyl material.

16. The structure of claim 10 which additionally comprises a hollow tube positioned in the aperture of said handle.

* * * * *